US007896177B1

(12) United States Patent
Toma

(10) Patent No.: US 7,896,177 B1
(45) Date of Patent: Mar. 1, 2011

(54) VERSATILE SUPPORT SYSTEM AND METHODS THEREOF

(76) Inventor: Dennis R. Toma, Las Vegas, NV (US)

( * ) Notice: Subject to any disclaimer, the term of this patent is extended or adjusted under 35 U.S.C. 154(b) by 322 days.

(21) Appl. No.: 12/117,489

(22) Filed: May 8, 2008

(51) Int. Cl.
*A47F 5/14* (2006.01)

(52) U.S. Cl. ..... 211/182; 312/265.4; 108/147.17; 206/577

(58) Field of Classification Search ..... 211/182, 211/189, 26; 312/265.1–265.4; 108/147.11, 108/147.12, 147.15; 403/170, 172; 248/235, 248/247, 220.1, 218.4, 250; 206/577
See application file for complete search history.

(56) References Cited

U.S. PATENT DOCUMENTS 3,144,946 A * 8/1964 Ellis ..... 211/182
4,158,998 A * 6/1979 Clement ..... 108/147.15
4,544,069 A * 10/1985 Cavallini ..... 211/183
4,678,359 A * 7/1987 Keen ..... 403/170
4,708,252 A * 11/1987 Azzi ..... 211/192
4,768,845 A * 9/1988 Yeh ..... 312/257.1
5,011,323 A * 4/1991 Liuo ..... 403/172
5,012,938 A * 5/1991 King ..... 211/191
5,020,866 A * 6/1991 Mcllwraith ..... 312/265.4
5,964,361 A 10/1999 Mefford et al.
6,062,664 A * 5/2000 Benner ..... 312/265.1
6,129,221 A 10/2000 Shaha
6,190,081 B1 * 2/2001 Besserer et al. ..... 403/231
6,352,164 B1 3/2002 Hyatte et al.
6,450,350 B1 9/2002 Krummell, Jr.
6,575,657 B1 * 6/2003 Reuter et al. ..... 403/231
6,662,983 B2 12/2003 Lane et al.
6,929,440 B1 8/2005 Grond
7,264,128 B2 9/2007 Herzog et al.
7,455,491 B1 * 11/2008 Nielson et al. ..... 410/16

* cited by examiner

*Primary Examiner*—Darnell M Jayne
*Assistant Examiner*—Stanton L Krycinski
(74) *Attorney, Agent, or Firm*—Landaleip, Inc.; David Landman

(57) ABSTRACT

A versatile support system, kit and methods of construction are disclosed. The support system comprises rail members, corner members and shelf brackets with each of the shelf brackets having an opening configured to selectively receive a fastener to couple a back portion of the shelf brackets to a surface of an outer portion of the rail members. The corner members have multiple arms selectively received and secured within an open inner region of a portion of each rail member. The versatile support system has improved load bearing capability and provides numerous load bearing structures with ease of construction.

16 Claims, 8 Drawing Sheets

VERSATILE SUPPORT SYSTEM AND METHODS THEREOF

FIELD OF THE INVENTION

This invention generally relates to framing systems, and more specifically, to a versatile support system with enhanced loading capabilities and methods for assembling various components of the support system.

BACKGROUND OF THE INVENTION

Various manufacturers have provided frame assemblies and equipment enclosures for storing demanding electronic equipment. Furthermore, many manufacturers have also provided frame assemblies for lighter duty applications, directed to different market segments.

In the past, with respect to equipment enclosures (commonly termed rack systems or rack assemblies), most such enclosures and frame assemblies were supplied by manufacturers in a fully assembled state and therefore required customization to comply with the needs of consumers. Consequently, costs for such enclosures increased significantly, and in an after-market sense, modification of such enclosures by consumers was difficult to achieve. Additionally the cost of shipping such finished enclosures was high because of their size.

Subsequently, certain knock-down components were offered in the market, which required tedious construction and specialized hardware and tools for constructing the knock-down components into a full enclosure. Amongst limitations that existed for such knock-down components were: size standardization, custom ordering for non-standard sized enclosures, assortment of parts needed for construction of the enclosure, time to construct the enclosure and strength considerations of the components and final enclosure.

Previously, the present inventor recognized the need for an improved system for constructing enclosures (otherwise termed frame assemblies, rack assemblies or rack systems in this application), and disclosed improved corner connectors for knock-down racks (see Toma, U.S. Pat. No. 6,968,962). Subsequently, the present inventor disclosed (see Toma, U.S. Pat. No. 6,962,262) improved corner connectors in combination with rail members and fasteners in a kit form which may be easily transported and provides all elements necessary for simple construction of a frame assembly, as well as other similar assemblies that make use of the improved corner connectors, rail members and fasteners as base elements of structures.

In many prior art electronic cabinets, racks and enclosures there are only vertical rack rails unlike the rack kit frame disclosed by the current inventor (see citations above). The rack kit frame disclosed by the current inventor also has horizontal front to back and left to right rail sets having one or more mounting holes. Additionally, most prior art electronic cabinets, racks and enclosures can only accommodate fastening of vertical rack rails to fully enclosed steel frames. Even open frame rack assemblies generally offer mounting holes only on vertical rack rails. In this respect, the current inventor's rack kit frame is unique because all three sets of rack rails have mounting holes along both legs of every rail making up the rack system.

However, while the current inventor's above described U.S. patents provided great flexibility in construction of rack systems wherein other substructures such as shelves could be integrated in the rack systems, it became evident that extensions in construction were highly desirable. However, such extensions should be highly durable, provide a suitably rigid final structural assembly and be easily installed in an existing rack system or rack assembly.

A number of disclosures show extension elements for various assemblies (see for example, Haworth, U.S. Pat. No. 6,269,959; Smith, U.S. Pat. No. 6,353,542; Mayer, U.S. Pat. No. 6,578,939; Hegrenes et al., U.S. Pat. No. 6,622,783; Williams et al., U.S. Pat. No. 6,655,534; Haney, U.S. Pat. No. 6,974,037; and Gray, U.S. Patent Application 2003/00198424). However, none of these extensions provide the desired rigidity and ease of installation.

Thus, improved and versatile support systems with enhanced loading capabilities and methods for assembling various components of the support systems is highly desirable.

SUMMARY OF THE INVENTION

An improved versatile support system with enhanced loading capabilities and methods for assembling various components of the support system is disclosed. The improved versatile support system may be available in kit form. Furthermore, the improved versatile support system may be economical and easy to install while providing great flexibility for modifying any existing frame assembly or rack system of the type disclosed previously by the current inventor. The components of such a versatile support system may be easily distributable and lead to economic benefits for both suppliers and consumers according to the distribution network used.

According to an embodiment of this disclosure, a versatile support system is disclosed. The system comprises in combination, one or more rail members having an end and an opposite end. Each of the one or more rail members have at least one channel extending along an elongated portion of the one or more rail members. Further, the system comprises one or more corner members having a first face, a second face and a third face. Each of the faces comprises a pair of arms projecting from a portion of each of the faces. Each of the pair of arms is configured to selectively couple to an inner portion of the one or more rail members. Further, the system comprises one or more shelf brackets. Each of the shelf brackets comprises a support member having a face and an opposite face, a first wall member and a second wall member adjacent to the support member. Furthermore, each of the wall members has an opening configured to selectively receive a fastener to couple a back portion of at least one of the wall members to a surface of an outer portion of at least one of the one or more rail members.

In another aspect of the disclosure, the at least one channel is configured to receive an edge portion of a sheet member. The at least one channel is defined by a portion of an outer surface of the one or more rail members and a portion of an outer surface of a substantially L-shaped projection substantially perpendicular to a portion of the outer surface of the one or more rail members.

In yet another aspect, the system further comprises a portion of an inner surface of each of the one or more rail members have a plurality of protrusion guides. Furthermore, each of the one or more rail members have an inner open region configured to selectively receive each of a pair of arms of each of the one or more corner members. Moreover, each of the one or more rail members have a second inner open region configured to receive a portion of an end of a brace member.

In a further aspect, the system comprises an extension of a portion of an outer surface of one or more of the rail members and a portion of the rail members have one or more openings to receive one or more fasteners. Further, a portion of each of the pair of arms is substantially perpendicular to a portion of a surface of a face corresponding to the pair of arms. Also, a first arm of the pair of arms is substantially perpendicular to a second arm of the pair of arms.

In another aspect, each of the first, second and third faces have a substantially L-shaped profile. Additionally, a portion of the surface of each of the one or more pair of arms has a plurality of guide grooves corresponding to one or more protrusions of an inner portion of each of the one or more rail members to align and securely couple a portion of the pair of arms to the one or more rail members. Further, each arm of the pair of arms has an opening configured to receive a fastener to secure the arm to a portion of the one or more rail members.

In yet another aspect, the system further comprises a lip extending inwardly from a portion of each of the wall members. Additionally, an edge of the first wall member is adjacent to an edge of the support member while, an edge of the second wall member is adjacent to an edge of the support member. Thus, the edges of the support member, the wall members and an edge of each lip define an opening of the shelf bracket configured to receive an end of a brace member. Moreover, the system comprises one or more threaded openings of the wall members configured to selectively receive one or more threaded fasteners.

In yet another aspect, a versatile support system kit is disclosed and has at least one of the following components: one or more rail members, one or more corner members, one or more shelf brackets as described above, and at least one set of instructions all being enclosed by a packaging material.

The foregoing and other objects, features, and advantages of the invention will be apparent from the following, more detailed description of the preferred embodiments of the invention, as illustrated in the accompanying drawings.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In the Summary and Preferred Embodiments above, the Description of the Invention, and the Claims and Abstract below, and in the accompanying drawings, reference may be made to particular features (including method steps) of the invention. It is to be understood that this disclosure includes most possible combinations of such particular features. For example, where a particular feature is disclosed in the context of a particular aspect or embodiment of the invention, or a particular claim, that feature may also be used, to the extent possible, in combination with and/or in the context of other particular aspects and embodiments of the invention, and in the invention generally.

The term "comprises" and grammatical equivalents thereof are used herein to mean that other components, ingredients, steps etc. are optionally present. For example, an article "comprising" (or "which comprises") components A, B and C can consist of (i.e. contain only) components A, B and C, or can contain not only components A, B and C but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility.

The term "at least" followed by a number or the word "a" is used herein to denote the start of a range beginning with that number (which may be a range having an upper limit or no upper limit, depending on the variable being defined). For example "at least one" means one or more than one and "at least a" means one or more.

The term "or" is used herein as a conjunction used to link one or more alternatives in a series of alternatives. The term "and/or" is used herein as a conjunction meaning that either or both of two options may be valid.

The terms "invention" and "disclosure" as used herein may be synonymous.

Figure 1:
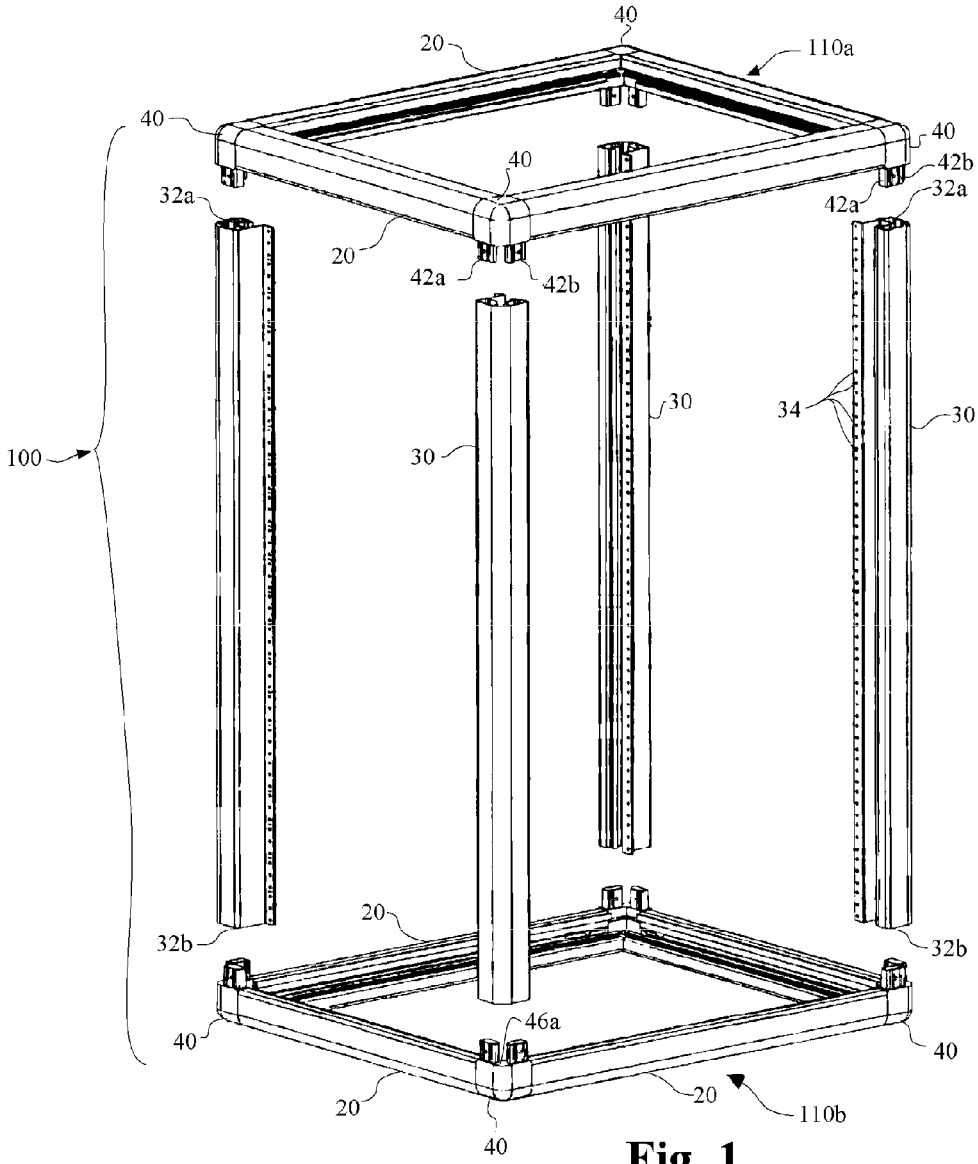
FIG. 1 depicts a front perspective view a support system configured as an assembly of various separated components in accordance with an embodiment of this invention.

FIG. 1 illustrates some aspects of a versatile support system 100 (hereinafter, "support system") according to an embodiment of the current disclosure. The support system (or assembly) 100 may comprise an assembly of various components (see the discussion below for a more detailed description of the various components). Without limiting the disclosure, as depicted in FIG. 1 the support system 100 comprises a top frame assembly 110*a*, a bottom frame assembly 110*b* and a second set of rail (or extrusion) members 30 (four shown in FIG. 1), with each of the rail members having a plurality of openings 34 (better seen in FIG. 3, and further described below). Further, the top frame assembly 110*a* and the bottom frame assembly 110*b* comprise a first set of rail (or extrusion) members 20. Naturally, a first rail member 20 could be exchanged with a second rail member 30 having a plurality of openings 34 in any support system 100. Furthermore, without limiting the disclosure, the plurality of openings 34 may have any suitable shape (such as one or more elongated openings and the like configured to receive a fastener).

Referring further to FIG. 1, both the top and the bottom frame members 110*a*, 110*b* may comprise a plurality of corner members 40. As depicted in FIG. 1, each corner member may comprise a first arm 42*a* and a second arm 42*b* extending from a portion of a first face surface 46*a* of each corner member 40 (not shown in FIG. 1, but see below for fuller description with reference to FIGS. 4 and 4A). As depicted in FIG. 1, the first arm 42*a* may be substantially perpendicular to the second arm 42*b*. Further each arm 42*a*, 42*b* may be coupled to a portion of an end 22*a* or an opposite end 22*b* each of the ends having an inner open region channel 24 configured to securely receive each of the arms (not clearly seen in FIG. 1, but see below for fuller description with reference to FIGS. 2, 2A and FIGS. 3, 3A, 4 and 4A).

Figure 2:
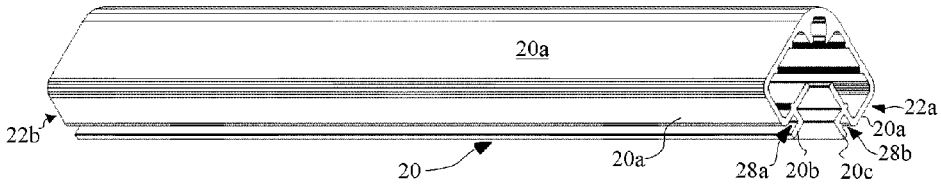
FIG. 2 depicts a front perspective view of a rail member in accordance with an embodiment of this invention.

Now, turning to FIG. 2, in a front perspective view of an embodiment of a first rail member 20 of the first set of rail (or extrusion) members, the first rail member comprises a substantially elongated element having an end 22*a* and an opposite end 22*b*. Further, the elongated element has a first channel 28*a* and a second channel 28*b* extending along the elongated element. Both the channels 28*a*, 28*b* are depicted in FIG. 2 (and see also FIG. 2A) as having a substantially U-shape. With respect to the first channel 28*a*, as depicted in FIG. 2, the channel is defined by a portion of an outer surface 20*a* of the rail member 20, and a portion of an outer surface of a substantially L-shaped projection (protrusion or sheet) 20*b* adjacent (or substantially perpendicular) to a portion of the outer surface of the rail member 20. In the same manner, the second channel 28*b* is defined by a portion of an outer surface 20*a* of the rail member 20 and a portion of an outer surface of another substantially L-shaped projection (protrusion or sheet) 20*c* adjacent (or substantially perpendicular) to a portion of the rail member 20. Of course, the number of channels 28 may be varied as desired (see for example the description of FIG. 3 below). Furthermore, naturally, the projections 20*b* and 20*c* may be shortened or elongated as desired, and may comprise a multiplicity of projections (not shown) having a gap between each of the projections.

Figure 2A:
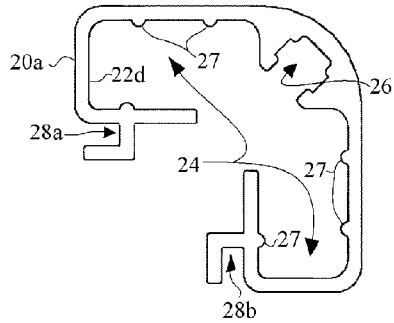
FIG. 2A depicts a plan view of an end of the rail member of FIG. 2.

Referring now to FIG. 2A, in a plan view of the end 22*a* of the rail member 20, the end has the substantially U-shaped channels 28*a*, 28*b* as discussed above. Each channel 28*a*, 28*b* is defined by a portion of an outer surface 20*a* of the rail member 20 and a portion of an outer surface of the L-shaped projections 20*b*, 20*c* respectively as discussed above with respect to FIG. 2. Moreover, a portion of an inner surface 20*d* of the rail member 20 comprises a plurality of protrusions 27. Besides providing enhanced rigidity to the rail member 20, these protrusions may serve as guides when receiving a portion of a corner member 40 (see description below with respect to FIGS. 4, 4A). Further, as depicted in FIG. 2A, the rail member 20 has the inner open region 24 configured to receive each of a pair of arms 44*a*, 44*b* (or 44*c*, 44*d* respectively depending on orientation) of the corner member 40 (see description below with reference to FIGS. 4, 4A). Additionally, the rail member 20 has another open region 26 located substantially on an opposite side of a curved portion of the outer surface 20*a* of the rail member. The open region 26 may have any shape, but as illustrated in FIG. 2A (and also in FIG. 3A) the shape resembles a head of a bolt (or a fastener that may be placed in the open region. Alternatively, the open region 26 may be configured to receive a reinforcing rod (not shown) having substantially a mirror image shape to the open region. Naturally, such a reinforcing rod may have a number of uses as well as acting as a reinforcement of the rail member 20.

Figure 3:
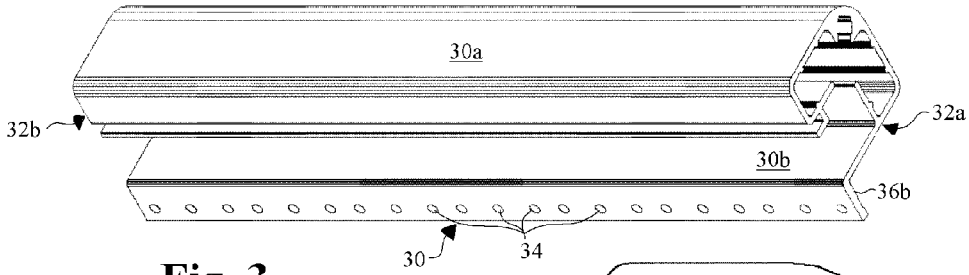
FIG. 3 depicts a front perspective view of a rail member in accordance with another embodiment of this invention.

According to FIG. 3, in a front perspective view of another embodiment of a rail member 30 of the second set of rail (or extrusion) members, the rail member comprises a substantially elongated element having an end 32*a* and opposite end 32*b*. Further, the elongated element has a channel 28 extending along the elongated element. The channel 28 is depicted in FIG. 3 (and see also FIG. 3A) as having a substantially U-shape. With respect to the channel 28, as depicted in FIG. 3, the channel is defined by a portion of an outer surface 30*a* of the rail member 30, and a portion of an outer surface of a substantially L-shaped projection (protrusion or sheet) 36*b* adjacent (or substantially perpendicular) to a portion of the outer surface of the rail member 30. However, in contrast to FIG. 2 and FIG. 2A, according to FIG. 3 (and also FIG. 3A) a portion of the outer surface 30*a* of the rail member 30 has an extension 36*b*. The extension 36*b* and a portion of the outer surface 30*a*, as well as a portion of the inner surface 30*b* define a substantially L-shape. In one aspect, when the rail member 30 comprises a formable metal (such as aluminum or steel and the like) the extension may be manufactured by simple bending of the outer surface 30*a* and inner surface 30*b*. However, as expected such shaping for a thermoset plastic material or a thermoplastic material may require a different manufacturing process (such as thermoforming or molding) as understood in the art of forming plastics and composites (such as polyester and glass or epoxy and carbon fibers or combinations thereof and the like). The L-shaped extension may have a plurality of openings 34 as discussed above with respect to FIG. 1. These openings 34 may receive one or more fasteners as desired and may be further coupled to any corresponding parts as desired (see FIGS. 7, 7A, 7B and 7C and the description below). Further, a portion of an inner surface 30*c* of the rail member 30 is depicted to be adjacent (or substantially perpendicular) to a portion of an outer surface of a projection (protrusion or sheet) 36*a* of the rail member 30. Thus, the projection 36*a* and the inner surface 30*c* may have a substantially T-shape. Naturally, the extension 36*b* and the projection 36*a* may be shortened or elongated as desired, and may comprise a multiplicity of projections (not shown) having a gap between each of the projections.

Figure 3A:
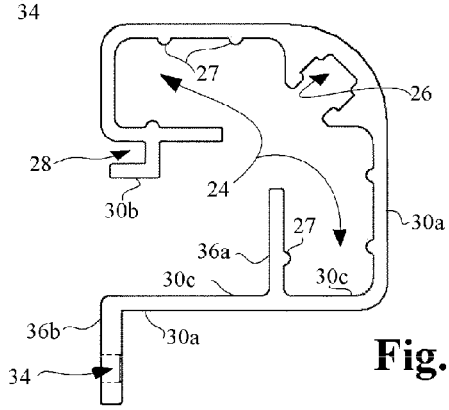
FIG. 3A depicts a plan view of an end of the rail member of FIG. 3.

Referring now to FIG. 3A, in a plan view of the end 32*a* of the rail member 30, the end has the substantially U-shaped channel 28 as discussed above (see FIG. 3 and FIG. 2A). The channel 28 is defined by a portion of an outer surface 30*a* of the rail member 30 and a portion of an outer surface of the L-shaped projection 30*b* as discussed above with respect to FIG. 3. Moreover, as depicted in FIG. 3A, a portion of an inner surface 30*c* (and the projection 36*a*) of the rail member 30 comprises a plurality of protrusions 27 as discussed above with respect to FIG. 2A. Further, as depicted in FIG. 3A, the rail member 30 has the inner open region 24 configured to receive each of a pair of arms 44*a*, 44*b* (or 44*c*, 44*d* respectively depending on orientation) of the corner member 40 (see description below with reference to FIGS. 4, 4A). Additionally, the rail member 30 has another open region 26 located substantially on an opposite side of a curved portion of the outer surface 30*a* of the rail member as discussed above with respect to FIG. 2A. Alternatively, the open region 26 may be configured to receive a reinforcing rod (not shown) as discussed above with respect to FIG. 2A.

Figure 4:
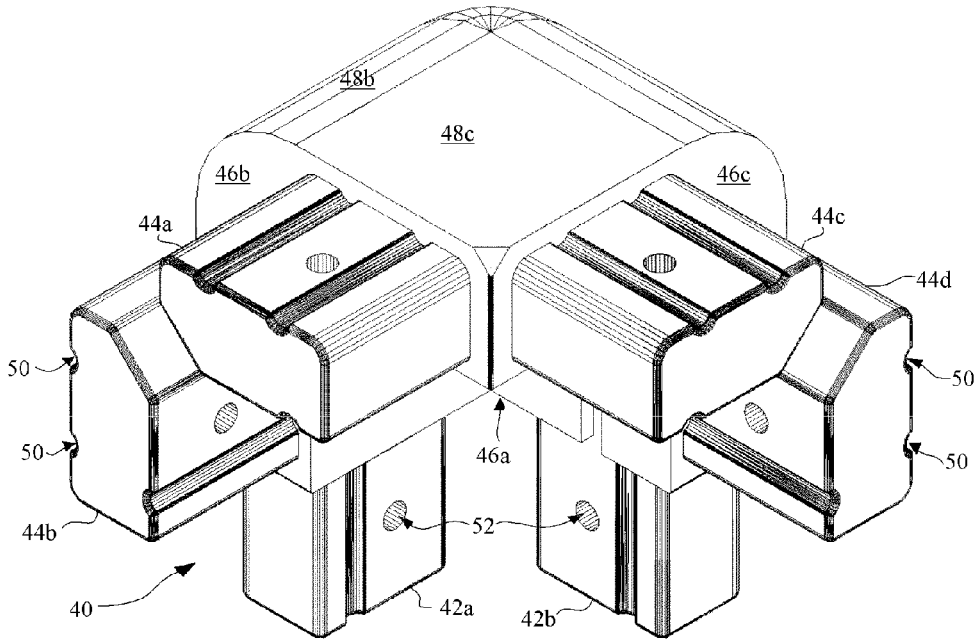
FIG. 4 depicts a front perspective view of a corner member in accordance with an embodiment of this invention.

Turning now to FIG. 4, without limiting the disclosure, an embodiment front perspective view of a corner member 40 is depicted. Furthermore, with reference to FIG. 4A a side perspective view of the corner member 40 is depicted to more easily describe various aspects of the corner member. Initially, as illustrated, the corner member 40 has a substantially planar first face surface 46*a*, a substantially planar second face surface 46*b* and a third contoured surface 48 (but having character numbers 48*a*, 48*b*, 48*c* for ease of description). Of course, the third contoured surface 48 may have any shape as desired and therefore is not critical to the functioning of the corner member 40.

With respect to the first face surface 46*a*, the corner member 40 has a first arm 42*a* and a second arm 42*b*. The first arm 42*a* and the second arm 42*b* extend (or project) substantially perpendicular to (from) the first face surface 46*a*. Furthermore, the first arm 42*a* is located on a portion of the first face surface 46*a* and is substantially perpendicular to the second arm 42*b* located adjacent to another portion of the first surface. Thus, the first face surface 46*a* (or first face of the corner member 40) has a substantially L-shaped profile. Naturally, without limiting the disclosure in other configurations (not shown), the angle between the first arm 42*a* and the second arm 42*b* could be larger (more obtuse) or smaller (more acute) than a right angle as desired. Advantageously, as explained earlier with reference to FIG. 1 (and also further discussed with reference to FIGS. 5 and 6, below), an outer portion of each of the arms 42*a*, 42*b* may be coupled to an inner portion of either one of the rail members 20 or 30 (see description above with respect to FIGS. 2, 2A, 3 and 3A).

Figure 4A:
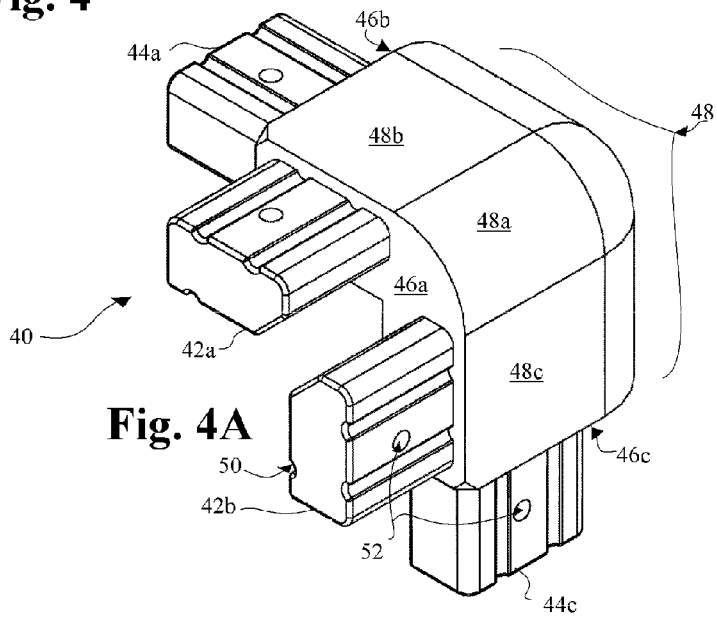
FIG. 4A depicts a side perspective view of the corner member of FIG. 4.

In another aspect of the arms 42*a*, 42*b*, as illustrated in FIGS. 4 and 4*a*, a portion of the surface of each of the arms has a plurality of channels (or grooves) 50. The channels (or grooves) 50 have a shape substantially corresponding to the protrusions 27 (see description above with respect to FIGS. 2, 2A, 3, 3A) to align and securely couple the arms 42*a*, 42*b* to a portion of the inner region 24 of the rail members 20 (or 30) as desired. Furthermore, each of the arms 42*a*, 42*b* has an opening 52 configured to receive a fastener 84*a*, 84*b* (see the description below with reference to FIGS. 7B and 7C). As expected the opening 52 may have threading to receive a screw type fastener (such as 84*a* in FIG. 7B) or a bolt type fastener (such as 84*b* in FIG. 7C). However, without limiting the disclosure any suitable fastening means may be used. Thus, in an aspect, the fastening means may be accomplished with spring loaded pins (not shown) and corresponding indentations (not shown) configured to receive a portion of the spring loaded pins. Naturally, the spring loaded pins might correspond to the protrusions 27 of a portion of the inner surface 22*d* of the rail members 20, 30 as described above, while the indentations may correspond to the openings 52 of the arms 42*a*, 42*b*.

In the same manner, with respect to the second face surface 46*b*, the corner member 40 has a first arm 44*a* and a second arm 44*b*. The first arm 44*a* and the second arm 44*b* extend (or project) substantially perpendicular to (from) the second face surface 46*b*. Furthermore, the first arm 44*a* is located on a portion of the second face surface 46*b* and is substantially perpendicular to the second arm 44*b* located adjacent to another portion of the second face surface. Thus, the second surface 46*b* (or second face of the corner member 40) has a substantially L-shaped profile. Naturally, without limiting the disclosure in other configurations (not shown), the angle between the first arm 44*a* and the second arm 44*b* could be larger (more obtuse) or smaller (more acute) than a right angle as desired. Advantageously, again, as explained, an outer portion of each of the arms 44*a*, 44*b* may be coupled to an inner portion of either one of the rail members 20 or 30 (see description above with respect to FIGS. 2, 2A, 3 and 3A). In the same manner, the description of all remaining aspects of the arms 44*a*, 44*b* is substantially the same as the descriptions above for the arms 42*a*, 42*b*.

Without laboring the discussion any further, with respect to the third face surface 46*c*, the corner member 40 has a first arm 44*c* and a second arm 44*d* extending (or projecting) substantially perpendicular to (from) the third surface. Moreover, the first arm 44*c* is located on a portion of the third face surface 46*c* and is substantially perpendicular to the second arm 44*d* located adjacent to another portion of the third surface (or third face of the corner member 40) having a substantially L-shaped profile. Once again, an outer portion of each of the arms 44*c*, 44*d* may be coupled to an inner portion of either one of the rail members 20 or 30 (see description above with respect to FIGS. 2, 2A, 3 and 3A). In the same manner, the description of all remaining aspects of the arms 44*c*, 44*d* is substantially the same as the descriptions above for the arms 42*a*, 42*b*, 44*a*, 44*b*.

Figure 5:
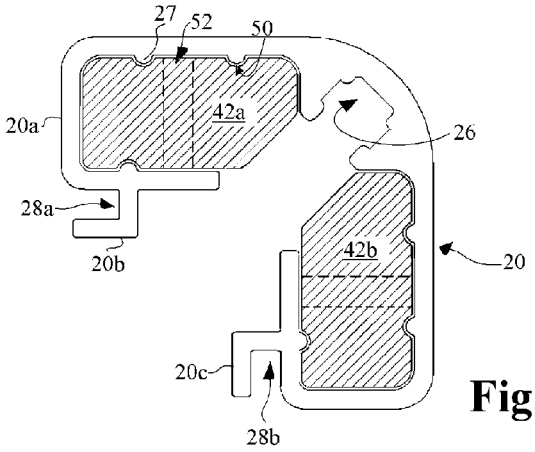
FIG. 5 depicts a plan view of a pair of arms of the corner member of FIG. 4 enclosed within a portion of an end of the rail member of FIG. 2A.

Referring now to FIG. 5, a plan view of two arm members such as 42*a*, 42*b* of the corner member 40 enclosed within a portion of an end 22*a* of the rail member 20 is illustrated (see also FIG. 2A and FIGS. 4, 4A for reference). Naturally, all features of the end 22*a* are substantially identical to those described above with respect to FIG. 2A. However, by way of example, FIG. 5 further clarifies the relationship of the arms 42*a*, 42*b* enclosed within a portion of the end of an embodiment of the rail member 20 (see also FIG. 2A). As described above, with respect to the arms 42*a*, 42*b*, a portion of the surface of each of the arms has a plurality of channels (or grooves) 50 having a shape substantially corresponding to the projections (or inner protrusions) 27 to align and securely couple the arms to a portion of the inner region 24 of the rail member 20 as desired. Furthermore, each of the arms 42*a*, 42*b* has an opening 52 (shown in dotted lines). Furthermore, as depicted in FIG. 2, the first U-shaped channel 28*a* is defined by a portion of an outer surface 20*a* of the rail member 20, and a portion of an outer surface of a substantially L-shaped projection (protrusion or sheet) 20*b* adjacent (or substantially perpendicular) to a portion of the outer surface of the rail member 20. In the same manner, the second U-shaped channel 28*b* is defined by a portion of an outer surface 20*a* of the rail member 20 and a portion of an outer surface of another substantially L-shaped projection (protrusion or sheet) 20*c* adjacent (or substantially perpendicular) to a portion of the rail member 20.

Figure 6:
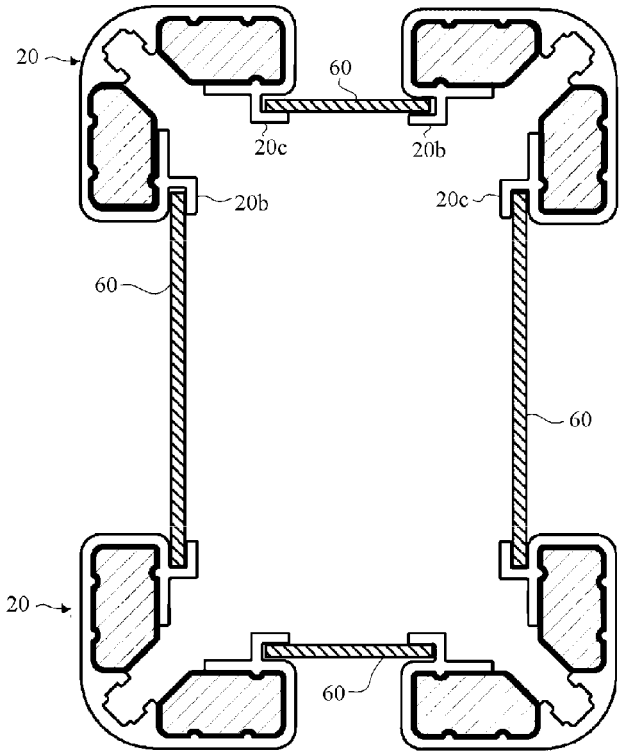
FIG. 6 depicts a plan view of a portion of each arm of four corner members enclosed within a portion of an end of each of four rail members as described above with respect to FIG. 5, and a portion of each of the ends each having a channel coupled to an end and opposite end of each of four sheet members.

FIG. 6 depicts a plan view of a portion of each arm (such as, for example, 44*a*, 44*b* or 44*c*, 44*d*) of four corner members 40 enclosed within a portion of an end 22*a* of each of four rail members as described above with respect to FIG. 5. Furthermore, a portion of each of the U-shaped channels 28*a*, 28*b* of the four rail members 20 defined by the L-shaped projections 20*b*, 20*c* may be selectively coupled to an end and opposite end of a sheet (or panel) member 60. As illustrated in FIG. 6, the four corner members 40 configured with four sheet members 60 form a prismatic (rectangular or square) shaped structure such as the one shown and described with respect to FIG. 1 (see above) having walls (the sheet members) rather than being open. In an aspect, the sheet member 60 may comprise a substantially opaque material such as wood, a filled plastic or composite plastic, a metal or an alloyed metal and the like. In another aspect, the sheet member 60 may comprise a substantially translucent material, such as a clear or smoked plastic or glass and the like.

Figure 7:
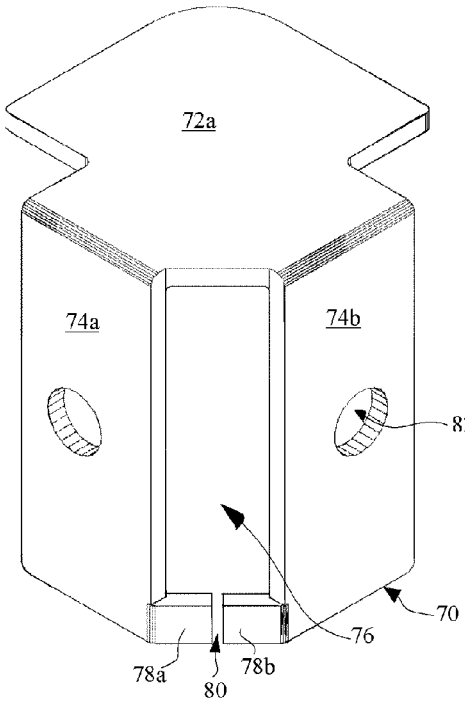
FIG. 7 depicts a back perspective view of a shelf bracket according to an embodiment of the invention.
Figure 7A:
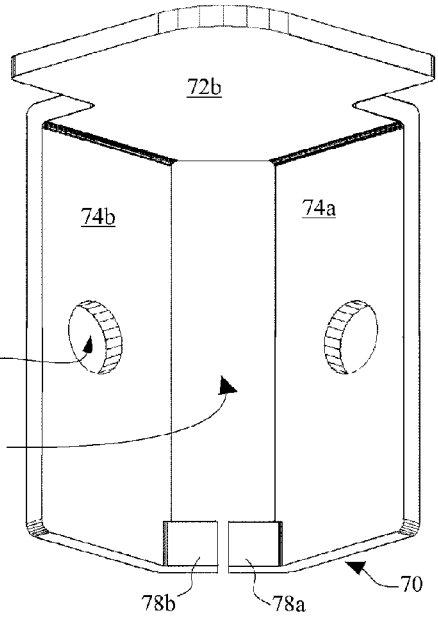
FIG. 7A depicts a front perspective view of the shelf bracket of FIG. 7.

FIG. 7 depicts a back perspective view of a shelf bracket 70, while FIG. 7A depicts a front perspective view of the shelf bracket. In an exemplary embodiment of the shelf bracket 70, the shelf bracket comprises a support member 72 having a face 72*a* and an opposite face 72*b*. Furthermore, the shelf bracket 70 comprises a pair of wall members 74*a*, 74*b* adjacent to the support member 72. As illustrated in FIGS. 7 and 7A, each of the wall members 74*a*, 74*b* may be substantially perpendicular to the support member 72. Additionally, each wall member 74*a*, 74*b* has an opening 82 configured to receive a fastener (see FIGS. 7B and 7C and the description below). In an aspect, the openings 82 may have threads to receive the fastener 84*a* (see FIG. 7B).

Referring further to FIGS. 7 and 7A, a portion of the first wall member 74*a* may further comprise a first lip 78*a* extending inwardly from the first wall member 74*a*. Similarly, a portion of the second wall member 74*b* may further comprise a second lip 78*b* extending inwardly from the second wall member 74*b*. As illustrated in both FIGS. 7 and 7A, the ends of each lip 78*a*, 78*b* may be separated, so that a portion of the ends of each lip defines a gap 80 located between the ends of the lips. Moreover, an edge of the first wall member 74*a* is adjacent to an edge of the support member 72. Further, the edge of the second wall member 74*b* is also adjacent to an edge of the support member 72. Consequently, the edge of the support member adjacent to the edges of the wall members 74*a*, 74*b* and an edge of each lip 78*a*, 78*b* define an opening 76 (see also the description and FIGS. 8, 11, 11A below).

Figure 7B:
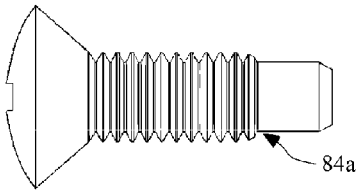
FIG. 7B depicts a front perspective view of an embodiment of a fastener adapted to couple a portion of the shelf bracket of FIG. 7 to a portion of the rail member of FIG. 3.

FIG. 7B depicts a front perspective view of an embodiment of a fastener 84*a* having threads. The fastener 84*a* may couple a portion of the shelf bracket 70 to a portion of the rail member 30. Alternatively, the fastener 84*a* may also couple other members to one another.

Figure 7C:
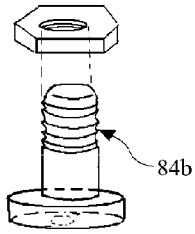
FIG. 7C depicts a front perspective view of an embodiment of another fastener configured as a screw and bolt.

FIG. 7C depicts a front perspective view of an embodiment of another fastener 84*b* configured as a nut and bolt.

Figure 8:
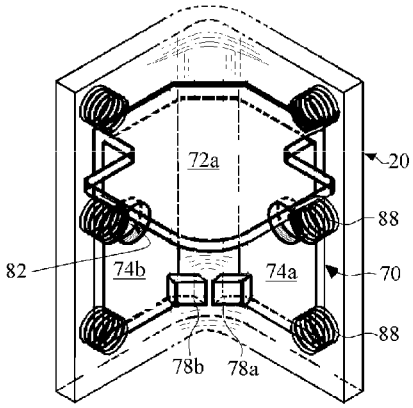
FIG. 8 depicts a front perspective view of the shelf bracket with a back portion of the shelf bracket adjacent to an inner portion of a rail member having one or more threaded openings.

FIG. 8 depicts a front perspective view of the shelf bracket 70 with a back portion of the wall members 74*a*, 74*b* of the shelf bracket adjacent to a relevant portion of outer surface 20*a* of a rail member 20 or a relevant portion of outer surface 30*a* and projection 36*a* of a rail member 30. In FIG. 8, there has been no attempt made to show all details of the rail members 20, 30. However, as may be seen, the rail members 20, 30 may have one or more openings 88. As depicted in FIG. 8, these openings 88 may be threaded and configured to receive one or more fasteners 84*a* as illustrated in FIG. 7B. It will be further appreciated that because of the opening 76 of the shelf bracket 70, a brace member 120 may be locked into the open region 26 of the rail member 20 or the rail member 30 (see FIGS. 4, 4A, 5, 6, 7, 9, 10, 10A, 11, 11A, 11B and the description both above and below).

Figure 9:
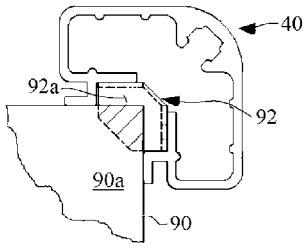
FIG. 9 depicts a top plan view of an embodiment of a shelf bracket with a back portion of the shelf bracket adjacent to an inner portion of the rail member of FIG. 2A and with a portion of a side of a shelf member supported by a top portion of the shelf bracket.

FIG. 9 depicts a top plan view of an embodiment of a shelf bracket 92 with a back portion of the shelf bracket adjacent to a portion of an outer surface 20*a* of the rail member 20. Further, a portion of an opposite side of a shelf member 90 (not shown, but the side 90*a* is shown in FIGS. 9 and 10) is supported by a face 92*a* of the support member 92 of the shelf bracket.

Figure 9A:
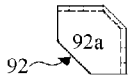
FIG. 9A depicts a top plan view of the shelf bracket illustrated in FIG. 9

FIG. 9A depicts a top plan view of the shelf bracket 92 described above with respect to FIG. 9 and illustrated in clearer detail.

Figure 10A:
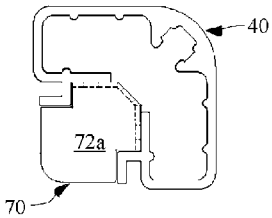
FIG. 10A depicts a top plan view of the shelf bracket of FIG. 7 with a back portion of the shelf bracket adjacent to an inner portion of the rail member of FIG. 2A.
Figure 10:
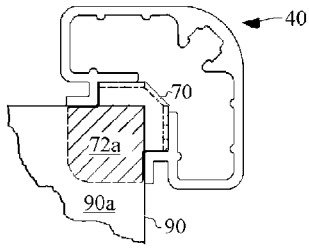
FIG. 10 depicts a top plan view of the shelf bracket of FIG. 7 with a back portion of the shelf bracket adjacent to an inner portion of the rail member of FIG. 2A and with a portion of a side of a shelf member supported by a top portion of the shelf bracket.
Figure 10B:
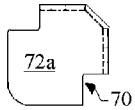
FIG. 10B depicts a top plan view of the shelf bracket illustrated in FIG. 10A.

In the same manner as for FIG. 9 above, FIG. 10 depicts a top plan view of an embodiment of a shelf bracket 70 with a back portion of the shelf bracket adjacent to a portion of an outer surface 20*a* of the rail member 20. Further, a portion of an opposite side of the shelf member 90 with the side 90*a* shown in FIGS. 9 and 10 is supported by a face 72*a* of the support member 70 of the shelf bracket. FIG. 10A depicts a top plan view of the shelf bracket 70 with a back portion of the shelf bracket adjacent to a portion of an outer surface 20*a* of the rail member 20. For clarity, the shelf member 90 has been omitted. FIG. 10B depicts a top plan view of the shelf bracket 70 described above with respect to FIG. 10 and illustrated in clearer detail (see also FIGS. 7 and 7A).

Figure 11:
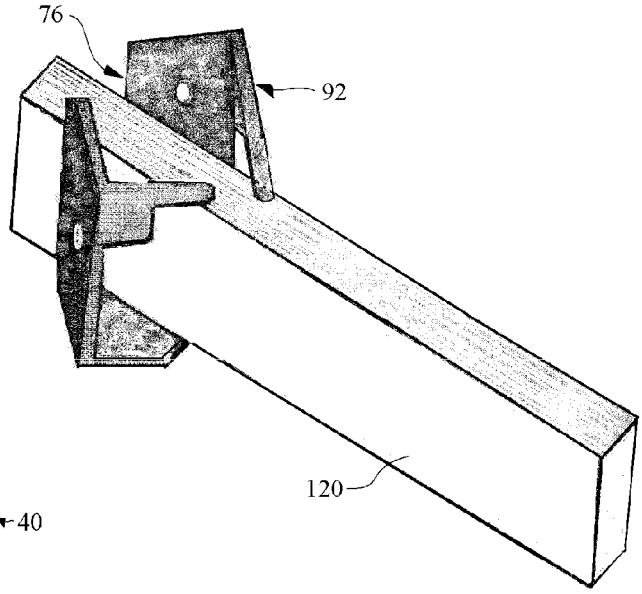
FIG. 11 depicts a front perspective view of the shelf bracket of FIG. 7 and a portion of a brace member located between a portion of the shelf bracket having an opening.

FIG. 11 depicts a front perspective view of the shelf bracket 92 and a portion of a brace member 120 located between a portion of the shelf bracket having an opening 76. In the same manner, FIG. 11A depicts a front perspective view of the shelf bracket 92 and a portion of the brace member 120 located between a portion of the shelf bracket having an opening 76, with the orientation of the shelf bracket being rotated compared to the view shown in FIG. 11 since a user might install the shelf bracket upside down as shown in FIG. 11. Thus, naturally, the arrangement for bracing a support system 100 such as shown in FIG. 1 could be accomplished in a variety of ways.

Figure 11B:
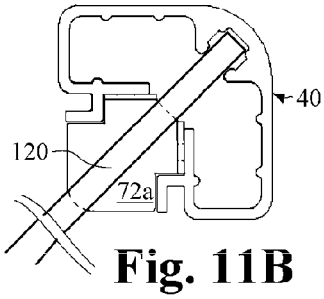
FIG. 11B depicts a top plan view of the shelf bracket of FIG. 7 with a back portion of the shelf bracket adjacent to an inner portion of the rail member of FIG. 2A together with the brace member of FIG. 11A.
Figure 11A:
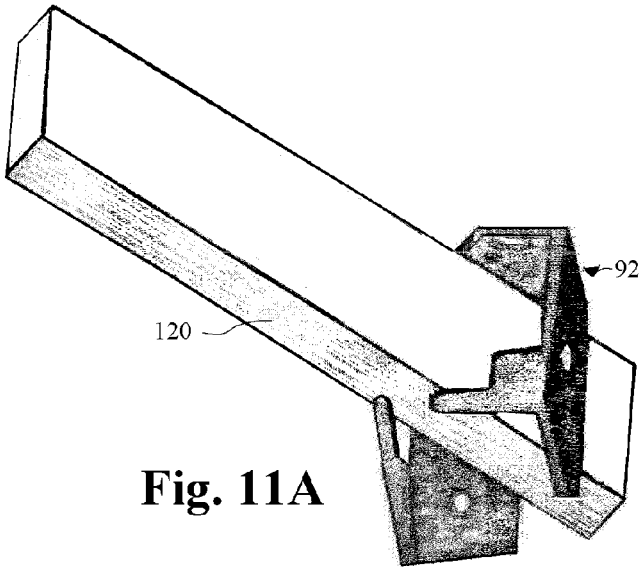
FIG. 11A depicts a front perspective view of the shelf bracket of FIG. 7 and a portion of the brace member located between a portion of the shelf bracket having an opening, with the orientation of the shelf bracket being rotated compared to FIG. 11.

FIG. 11B depicts a top plan view of the shelf bracket 70 with a back portion of the shelf bracket adjacent to an inner portion of the rail member 20 together with the brace member of FIG. 11.

Figure 12:
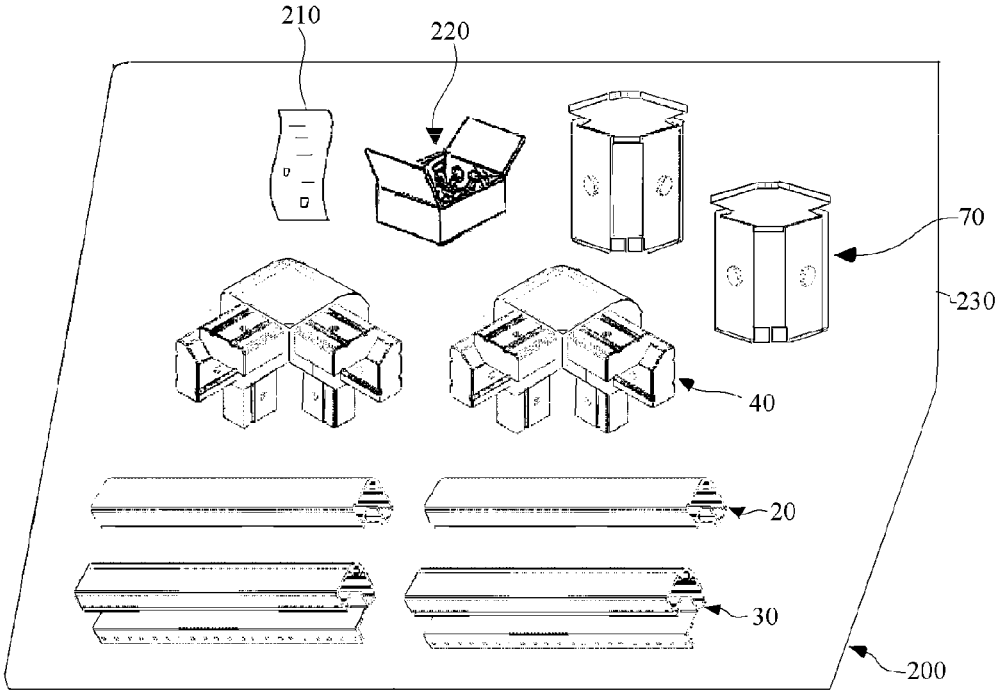
FIG. 12 depicts a kit comprising several aspects of a versatile support system and an instruction sheet enclosed by a packaging material according to an embodiment of the invention.

FIG. 12 depicts a kit 200 comprising several components of a versatile support system and an instruction sheet 210 enclosed by a packaging material 230 according to an embodiment of the invention. More specifically, but without limiting the disclosure, the kit 200 may comprise one or more rail members, 20, 30, one or more corner members 40, one or more shelf brackets 70, a container 220 having one or more fasteners, the instructions 210 enclosed by the packaging material 230. Naturally, the kit 200 may further comprise one or more brace members 120 as described above. The container 220 may comprise a box, plastic housing, plastic film and the like as is known in the art. Of course, the kit 200 may be configured to also comprise one more accessory members such as leveling feet, casters, shelves, drawers, panels and the like as desired (not shown), which could be attached to any versatile support system that may be constructed.

Since it is clear that the currently disclosed versatile support system has certain features that are similar to the current inventor's previously disclosed patent applications U.S. Pat. No. 6,968,962 and U.S. Pat. No. 6,962,262, a better understanding of the versatility inherent herein may be gleaned by inspection of those patents. Additionally, the current inventor has yet another U.S. patent application Ser. No. 11/532,561 dated Sep. 18, 2006 entitled "SUPPORT DEVICES, KITS AND METHODS THEREOF" on file, which shows yet other features that could be used in combination with the currently described disclosed features.

It is understood that the thickness of the sheet member 60 and the brace member 120 may be sized as needed. Furthermore, the materials of construction for any of the features described herein may comprise any metal, nonmetal and combinations thereof including (but not limited to) plastics, glass fibers, carbon fibers, alloys of metals, ceramics and the like as is understood in the art. Naturally, the components of any versatile support system structure may comprise rigid materials.

Exemplary Method of a Versatile Support System

In operation, a first portion of a kit 200 may comprise a pair of frames 110*a*, 110*b* including all components as described above by referring to FIG. 1 and may further include necessary fasteners 84*a* such as in the box 220 of FIG. 12. Without limiting the disclosure, the first portion of the kit 200 may include a preassembled four-sided bottom frame assembly 110*b* and a preassembled four-sided top frame assembly 110*a*. Specifically, as illustrated in FIG. 1, each frame 110*a*, 110*b* has four connecting members 40. The bottom preassembled frame assembly may have additional (for example, 5/16") threaded holes (not shown) located in either of the rail members 30 or the corner members 40 to selectively accommodate leveling feet, casters, anchors, other accessories and the like. Further, a second portion of the kit 200 may comprise the four rail members 30 having openings 34 (for example, 10-32 tapped holes).

It is understood that according to the method described herein, a specific order of assembly of the versatile support assembly (or apparatus) 100 is not necessarily required.

In a first step S1 of the method, all components of the first portion and the second portion of the kit 200 may be unpacked in preparation for assembling the versatile support assembly 100. In a second step S2, the bottom frame assembly 110*b* may be placed on a flat work surface so that, for example, the 5/16" threaded holes or openings as described above may rest against a substantially flat work surface. In this manner leveling feet and the like as described above, may be easily coupled to the bottom support frame assembly 110*b* (see below for further description).

In a step S3, an opposite end 32*b* of each of the rail members 30 may be aligned (as described with reference to FIGS. 4, 4A and 5) above and coupled to a pair of arms 42*a*, 42*b* (or 44*a*, 44*b* or 44*c*, 44*d*) of a corresponding corner member 40 as described and shown in FIG. 5 (see above). In a following step S4, each of the pair of arms 42*a*, 42*b* may be coupled (or screwed) to each corresponding rail member 30 with, for example, one or more of the fasteners 84*a*. As illustrated in FIG. 1, the arms 42*a*, 42*b* may be coupled to the opposite end 32*b* of each of the corresponding rail members 30.

In an optional aspect S5 of the method, decreased tightening of the fasteners (screws) 84*a* may be desired prior to complete tightening of the screws 84*a* in step S4 to facilitate alignment of the top frame assembly 110*a* to the end 32*a* of each of the rail members 30.

In a step S6 of the method, the top frame assembly 110*a* may be aligned with each end 32*a* of a corresponding rail member 30 and coupled to a corresponding pair of arms 42*a*, 42*b* (as illustrated in FIG. 1 and FIGS. 5, 6). In a step S7, just as described above with respect to the opposite end 32*b*, after alignment of openings (not shown) of the ends 32*a* to the openings 52 of the arms 42*a*, 42*b*, each of the pair of arms of the top frame assembly 110*a* may be coupled (or screwed) to each end 32*a* of each corresponding rail member 30 and secured tightly as desired.

In an optional step S8 of the method (see above), leveling feet and the like may be mounted into or coupled to (for example, four 5/16" threaded holes) of each corresponding corner member 40 of the bottom frame assembly 110*b* thereby providing the support assembly 100. In yet another optional step S9, the support assembly's 100 leveling feet may be raised or lowered as desired according to the amount of clearance desired from a floor surface and to the flatness of the floor surface. In yet another optional step S10 of the method, as described above and shown in FIG. 6, one or more sheet members (panels) 60 may be coupled to the grooves 20*b* and 20*c* of adjacent corner members 40. In yet a further step S11, as described above and shown in FIGS. 11, 11A, 11B, one or more brace members 120 may be coupled to opposing shelf brackets 72 or 92 pre-coupled to a portion of the rail members 20 or 30. Of course another optional step S12 of the method comprises coupling one or more of the shelf brackets 72 or 92 to a portion of the rail members 20 or 30 as described and illustrated in FIGS. 8, 9 and 10, while in a step 13 one or more shelf members 90 may be supported by one or more corresponding shelf brackets 70 or 92.

Without limiting the disclosure, some examples of structures that may be built using the disclosed versatile support system include: a plasma or LCD TV stand, a rack, a table or cocktail table, a desk, a rack with drawers, and the like, thereby demonstrating the versatility of the support system 100. Thus, it may be seen that such a versatile support system has multiple benefits and advantages. In particular it should be noted that such versatile support assemblies may support enhanced loads in excessive of 2800 pounds and clearly may be readily assembled by even the most novice consumer.

While the invention has been particularly shown and described with reference to preferred embodiments thereof, it will be understood by those skilled in the art that the foregoing and other changes in form and details may be made therein without departing from the spirit and scope of the invention. The scope of the present invention is not intended to be limited by the specific examples set out herein, but rather is to be interpreted according to the following claims.

What is claimed is:

1. A versatile support assembly, comprising, in combination:

a plurality of rail members having an end and an opposite end, each of said one or more rail members having at least one channel extending along each one of an elongated outer portion of said rail members;

a plurality of corner members having a first face, a second face and a third face, each of said faces comprising a pair of arms projecting from a portion of each of said faces, each of said pair of arms configured to selectively couple to an inner portion of said rail members, wherein said at least one channel configured to receive an end and opposite end of a sheet member when each of said rail members is coupled to at least two of said corner members; and a plurality of shelf brackets, each of said shelf brackets comprising a horizontal support member having a top face and an bottom face, a first wall member and a second wall member adjacent to and extending perpendicularly to said horizontal support member, a lip extending inwardly from a portion of each of said wall members configured to receive an end of a brace member, a gap defined between each lip of each of said wall members, and each of said wall members having an opening configured to selectively receive a fastener to couple a back portion of at least one of said wall members to a surface of an outer portion of an inner corner of at least one of said rail members, wherein an edge of said first wall member is adjacent to an edge of said horizontal support member, an edge of said second wall member is adjacent to an edge of said horizontal support member, said edges of each one of said horizontal support member, said wall members and each edge of each lip of each of said wall members defining an opening of each one of said shelf brackets configured to receive an end of said brace member.

2. The assembly of claim 1, wherein said at least one channel is configured to receive an edge portion of said sheet member.

3. The assembly of claim 1, wherein said at least one channel is defined by a portion of an outer surface of said rail members and a portion of an outer surface of a substantially L-shaped projection substantially perpendicular to a portion of said outer surface of said rail members.

4. The assembly of claim 1, further comprising a portion of an inner surface of each of said rail members having a plurality of protrusion guides.

5. The assembly of claim 1, wherein each of said rail members having an inner open region configured to selectively receive each of a pair of arms of each of said corner members.

6. The assembly of claim 1, wherein each of said rail members having a second inner open region configured to receive a portion of an end of said brace member.

7. The assembly of claim 1, further comprising an extension of a portion of an outer surface of one or more of said rail members, a portion of said rail members having one or more openings to receive one or more fasteners.

8. The assembly of claim 1, wherein a portion of each of said pair of arms is substantially perpendicular to a portion of a surface of one of said faces corresponding to said pair of arms.

9. The assembly of claim 1 wherein a first arm of said pair of arms is substantially perpendicular to a second arm of said pair of arms.

10. The assembly of claim 1, wherein each of said first, second and third faces has a substantially L-shaped profile.

11. The assembly of claim 1, wherein a portion of the surface of each of said pair of arms has a plurality of guide grooves corresponding to one or more protrusions of an inner portion of each of said rail members to align and securely couple a portion of said pair of arms to said rail members.

12. The assembly of claim 1, wherein each arm of said pair of arms has an opening configured to receive a fastener to secure said arm to a portion of said rail members.

13. The assembly of claim 1, comprising one or more threaded openings of each of said wall members configured to selectively receive one or more threaded fasteners.

14. A kit comprising in combination at least one assembly according to claim 1, and at least one set of instructions for assembling said at least one assembly, said instructions and said at least one assembly enclosed by a packaging material.

15. The versatile support assembly according to claim 1, is configured to support loads in excess of 2800 pounds.

16. The kit according to claim 14, wherein the at least one assembly is configured to support loads in excess of 2800 pounds.

* * * * *